US009365405B2

(12) United States Patent
Stratton

(10) Patent No.: US 9,365,405 B2
(45) Date of Patent: Jun. 14, 2016

(54) BEVERAGE DISPENSING SYSTEM

(76) Inventor: Gus Stratton, La Verne, CA (US)

( * ) Notice: Subject to any disclaimer, the term of this patent is extended or adjusted under 35 U.S.C. 154(b) by 0 days.

(21) Appl. No.: 13/433,853

(22) Filed: Mar. 29, 2012

(65) Prior Publication Data

US 2013/0214000 A1 Aug. 22, 2013

Related U.S. Application Data

(60) Provisional application No. 61/600,365, filed on Feb. 17, 2012.

(51) Int. Cl.

| | |
|---|---|
| ***B67D 1/04*** | (2006.01) |
| ***B67D 1/00*** | (2006.01) |
| *B67D 1/08* | (2006.01) |

(52) U.S. Cl.

CPC ..... *B67D 1/0462* (2013.01); *B67D 1/0021* (2013.01); *B67D 1/0057* (2013.01); *B67D 1/0078* (2013.01); *B67D 2001/0827* (2013.01)

(58) Field of Classification Search

USPC ..... 222/105, 203, 95, 202, 200, 196, 129.1, 222/399; 366/114

See application file for complete search history.

(56) References Cited

U.S. PATENT DOCUMENTS

| | | | | |
|---|---|---|---|---|
| 2,858,051 | A * | 10/1958 | Cunningham | 222/103 |
| 3,790,029 | A | 2/1974 | Ward | |
| RE30,301 | E | 6/1980 | Zygiel | |
| 4,771,917 | A * | 9/1988 | Heaps et al. | 222/92 |
| 4,934,567 | A | 6/1990 | Vahjen et al. | |
| 5,000,352 | A | 3/1991 | Cleland | |
| 5,082,143 | A | 1/1992 | Schramm, Jr. | |
| 5,575,405 | A | 11/1996 | Stratton et al. | |
| 5,738,248 | A | 4/1998 | Green | |
| 5,743,433 | A | 4/1998 | Hawkins | |
| 5,788,449 | A * | 8/1998 | Riemersma | 414/415 |
| 6,045,007 | A | 4/2000 | Simmons | |
| 6,059,145 | A | 5/2000 | Stratton et al. | |
| 6,142,661 | A * | 11/2000 | Lafond | 366/204 |
| 6,364,159 | B1 | 4/2002 | Newman et al. | |
| 6,550,642 | B2 | 4/2003 | Newman et al. | |
| 7,334,702 | B2 * | 2/2008 | Cunningham et al. | 222/1 |
| 7,810,679 | B2 * | 10/2010 | Wauters et al. | 222/399 |
| 8,210,736 | B2 | 7/2012 | Raber | |
| 8,499,972 | B1 * | 8/2013 | Landry | 222/105 |
| 2004/0206780 | A1 * | 10/2004 | Sterner et al. | 222/202 |
| 2007/0114243 | A1 | 5/2007 | Kershaw et al. | |
| 2008/0078781 | A1 * | 4/2008 | Py et al. | 222/96 |
| 2010/0206900 | A1 * | 8/2010 | Dobrusskin et al. | 222/95 |
| 2012/0104020 | A1 | 5/2012 | Cur et al. | |

* cited by examiner

*Primary Examiner* — Donnell Long
(74) *Attorney, Agent, or Firm* — Brooks Kushman P.C.

(57) ABSTRACT

A combination beverage concentrate and concentrate bag and an apparatus for using the combination. The combination is adapted for use in the preparation of a finished beverage having a first volume of the beverage concentrate and a second volume of diluent. The concentrate bag is flexible, disposable and has a volume equal to or greater than the sum of the first volume and the second volume. A first volume of the beverage concentrate is disposed within the concentrate bag. The apparatus is adapted to accept the diluent-filled combination, mix the diluent with the beverage concentrate and dispense finished beverage from a dispenser. In the dispensing system, connections for providing diluent or a pressurizing agent to the beverage concentrate or to the finished beverage are located at the dispenser outlet opening or upstream of that opening.

6 Claims, 3 Drawing Sheets

BEVERAGE DISPENSING SYSTEM

CROSS-REFERENCE TO RELATED APPLICATION

This application claims priority from Provisional Patent Application Ser. No. 61/600,365, filed Feb. 17, 2012, entitled BEVERAGE DISPENSING SYSTEM, which is incorporated in its entirety herein.

FIELD OF THE INVENTION

The invention is directed to beverage dispensing systems, and, more specifically, to systems for dispensing low-acid beverages.

BACKGROUND OF THE INVENTION

As illustrated in FIG. 1, prior art beverage distribution systems generally employ a flexible bag 1 which is disposed in the upper section of a dispenser 2. The flexible bag contains a beverage concentrate. The flexible bag gravitates beverage concentrate to the suction side of a pump 3. The suction side of the pump also accepts tap water from a tap water source 4 conveyed to the pump by a tap water line 5. The pump pumps the mixture of beverage concentrate and water through a distribution tube 6 to a distribution tube opening 7. When the end user opens a valve 8 at the end of the distribution tube, the mixture of beverage concentrate and water is caused to flow into the user's beverage receptacle.

A major problem with such prior art systems is bacteria growth. This is especially a problem when dispensing low-acid beverages (beverages having a pH of greater than 4.6). Bacteria tends to grow up from the opening in the distribution tube, upstream towards the flexible bag. Such bacterial growth can contaminate the pump and the water transfer line. This can at least lead to serious maintenance problems.

Additional problems with beverage dispensing systems of the prior art arise from the fact that the finished beverage is fully prepared at a production location and then shipped in the flexible bag to a dispensing location. First of all, the additional weight of the finished beverage results in large costs of shipment. Secondly, low-acid finished beverages must be refrigerated during shipment, resulting in still larger costs of shipment.

SUMMARY OF THE INVENTION

The invention satisfies this need. In one sense, the invention is a beverage concentrate and concentrate bag combination wherein the beverage concentrate to be used in a finished beverage comprising a first volume of the beverage concentrate and a second volume of diluent. The concentrate bag is flexible and disposable and has a volume substantially equal to the sum of the first volume and the second volume. In the invention, the bag contains a first volume of the beverage concentrate.

In a second sense, the invention is a method of using the above-described combination for dispensing the finished beverage. In this sense of the invention, the volume of the concentrate bag need not be substantially equal to the sum of the first volume and the second volume. It is sufficient that the volume of the concentrate bag be at least equal to the sum of the first volume and the second volume. In this second sense of the invention, the method comprises the steps of (a) providing a disposable, flexible concentrate bag having a total volume equal to or greater than the sum of the first volume and the second volume, (b) filling the flexible bag with a first volume of beverage concentrate at a production location, (c) shipping the flexible bag with the first volume of beverage concentrate from the production location to a dispensing location separate from the production location, (d) filling the flexible bag containing the first volume of beverage concentrate with a second volume of diluent at the dispensing location, (e) mixing the beverage concentrate and the diluent within the beverage bag to produce the finished beverage, and (f) dispensing the finished beverage from the flexible bag to a dispenser outlet nozzle without adding a pressurizing agent to the finished beverage downstream of the flexible bag.

In a third sense, the invention is a beverage dispensing system for dispensing the finished beverage using the beverage concentrate and concentrate bag combination described above. In this sense of the invention, the beverage apparatus comprises (a) a dispenser compartment, (b) a disposable, flexible bag situated within the dispenser compartment, the flexible bag having a bag outlet opening and a volume equal to or greater than the sum of the first volume and the second volume, (c) a mixer adapted to mix beverage concentrate and diluent within the flexible bag, and (d) a dispenser outlet nozzle for dispensing the finished product, the dispenser outlet nozzle being in fluid tight communication with the flexible bag. In this third sense of the invention, all connections for providing diluent or a pressurizing agent to the beverage concentrate or to the finished beverage are disposed at the dispenser outlet opening or upstream thereof.

DRAWINGS

These and other features, aspects and advantages of the present invention will become better understood with reference to the following description, appended claims and accompanying drawings where:

DETAILED DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well.

As noted above, in one sense, the invention is a beverage concentrate and concentrate bag combination 10 wherein the beverage concentrate to be used in a finished beverage comprising a first volume of the beverage concentrate and a second volume of diluent. The combination 10 comprises a beverage concentrate bag 12 which is flexible and disposable and has a volume substantially equal to the sum of the first volume and the second volume. In the invention, the flexible bag 12 contains a first volume of the beverage concentrate.

By "substantially equal to the sum of the first volume and the second volume," it is meant that the volume of the flexible bag 12 is at least as large as the sum of the first volume and the second volume and up to 5% greater than the sum of the first volume and the second volume.

Figure 1:
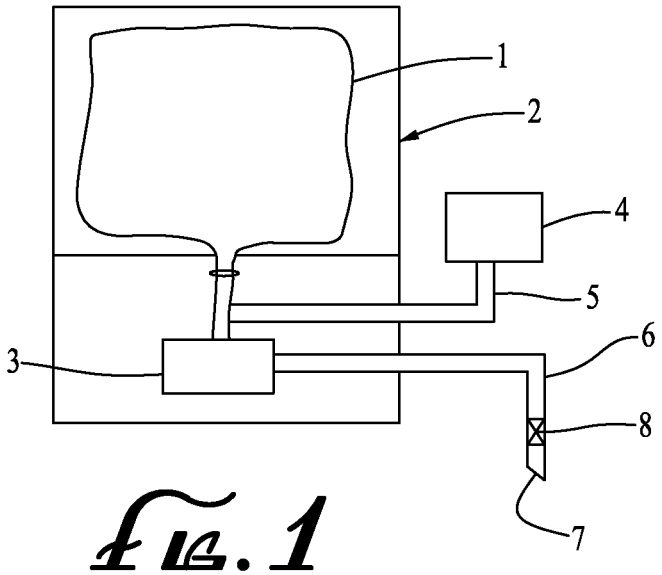
FIG. 1 PRIOR ART
FIG. 1 is a diagrammatic representation in cross-section of a beverage dispensing system having features of the prior art.
Figure 2:
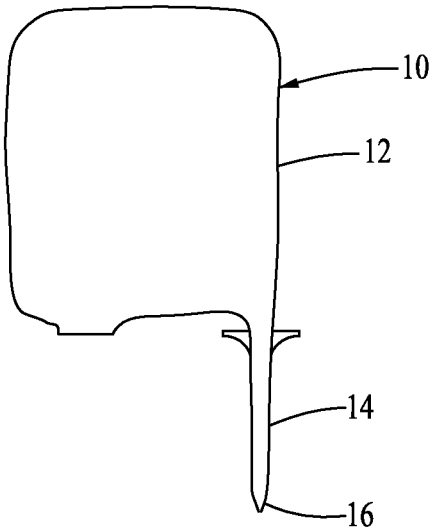
FIG. 2 is a diagrammatic representation of a concentrate bag having features of the invention.

The beverage concentrate and concentrate bag combination 10 is illustrated in FIG. 2. The concentrate bag 12 is preferably of thin film flat shaped plastic, having an outlet tube 14 provided with a sealed end 16 which can be cut off to form a bag outlet opening 18.

Figure 3:
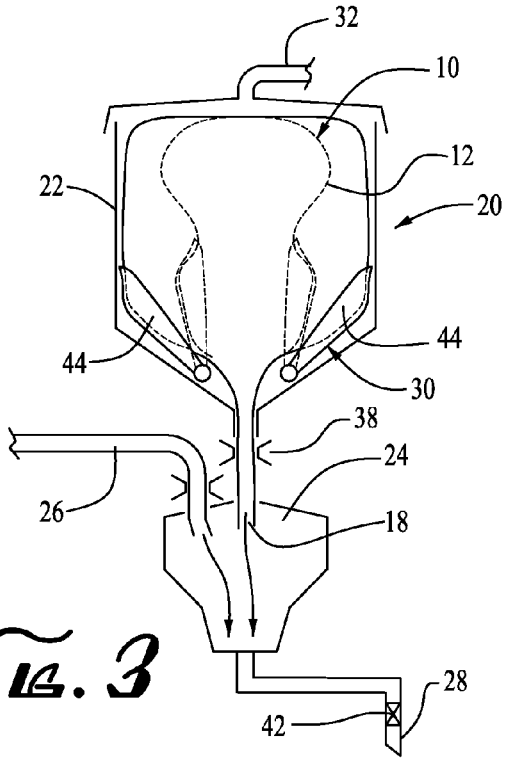
FIG. 3 is a diagrammatic representation in cross-section of a first beverage dispensing system having features of the invention.

FIG. 3 illustrates a fountain beverage dispensing system 20 using the beverage concentrate and concentrate bag combination 10 of the invention. This fountain dispensing system 20 comprises a concentrate dispenser 22 and a mixing chamber 24. The mixing chamber 24 is adapted to mix beverage concentrate from the beverage concentrate bag 12 with diluent provided from a diluent source using a diluent supply conduit 26. Preferably, the dispenser nozzle 28 is disposable.

In the embodiment illustrated in FIG. 3, the dispenser 22 is optionally equipped with a mixer 30 in the form of a beverage homogenizing agitator disposed near the bottom of the dispenser 22. Some beverages, being of organic composition, have a tendency to deposit sedimentation at the bottom of the flexible bags 12. The use of a beverage homogenizing agitator at the bottom of the flexible bag 12 minimizes sedimentation problems.

In this beverage dispensing system 20, the dispensing of beverage concentrate through the bag outlet opening 18 is facilitated by pressurized gas, such as air or carbon dioxide, provided into the dispenser 22, exterior to the beverage concentrate bag 12, via a pressurized gas conduit 32.

In a second sense, the invention is a method of using the above-described combination for dispensing the finished beverage. In this sense of the invention, the volume of the concentrate bag 12 need not be substantially equal to the sum of the first volume and the second volume. It is sufficient that the volume of the concentrate bag 12 be at least equal to the sum of the first volume and the second volume. In this second sense of the invention, the method comprises the steps of (a) providing a disposable, flexible concentrate bag 12 having a total volume equal to or greater than the sum of the first volume and the second volume, (b) filling the flexible bag 12 with a first volume of beverage concentrate at a production location, (c) shipping the flexible bag 12 with the first volume of beverage concentrate from the production location to a dispensing location separate from the production location, (d) filling the flexible bag 12 containing the first volume of beverage concentrate with a second volume of diluent at the dispensing location, (e) mixing the beverage concentrate and the diluent within the beverage bag 12 to produce the finished beverage, and (f) dispensing the finished beverage from the flexible bag 12 to a dispenser outlet nozzle 28 without adding a pressurizing agent to the finished beverage downstream of the bag outlet opening 18.

In a third sense, the invention is a beverage dispensing apparatus 34 for dispensing the finished beverage using beverage concentrate and a concentrate bag 12. In this sense of the invention, the beverage apparatus 34 comprises (a) a dispenser 22, (b) a disposable, flexible bag 12 situated within the dispenser 22, the flexible bag 12 having a bag outlet opening 18 and a volume equal to or greater than the sum of the first volume and the second volume, (c) a mixer 30 adapted to mix beverage concentrate and diluent within the flexible bag 12, and (d) a dispenser outlet nozzle 28 for dispensing the finished product, the dispenser outlet nozzle 28 being in fluid tight communication with the flexible bag 12.

In this third sense of the invention, all connections for providing diluent or a pressurizing agent to the beverage concentrate or to the finished beverage are disposed at the flexible bag outlet opening 18 or upstream thereof. Preferably, all connections for providing diluent or a pressurizing agent in the beverage dispensing apparatus 34 to the beverage concentrate or to the finished beverage are disposed upstream of the bag outlet opening 18.

The beverage dispensing apparatus 34 of the invention is especially useful in the dispensing of low-acid beverages.

Figure 4:
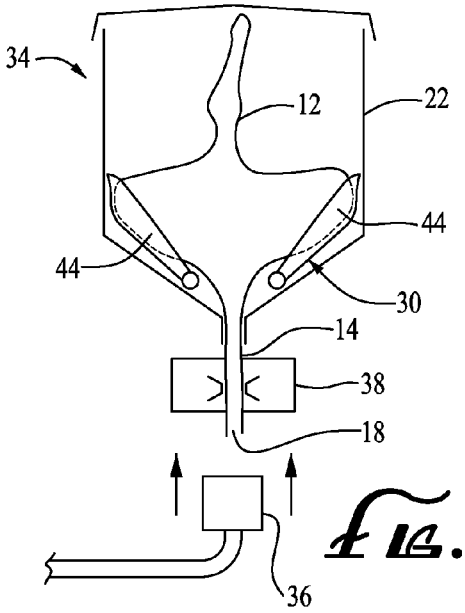
FIG. 4 is a diagrammatic representation in cross-section of a second dispensing system having features of the invention.

FIG. 4 illustrates a second beverage dispensing apparatus 34 having features of the invention. In this embodiment, the dispenser 22 is typically sized and dimensioned to conform to the flexible bag 12 when the bag 12 is fully filled. Also in this embodiment, diluents are added to the flexible bag 12 using a diluent-filling attachment 36 connected to the concentrate bag 12 at the bag outlet opening 18. The diluent-filling attachment 36 typically extends from a source of diluents which is located away from the concentrate outlet tube 14.

The concentrate outlet tube 14 can be disposed through a pinch valve 38 which is preferably of a cam-and-lever spring-loaded design, and is suitable for low pressure or gravity flow. In the embodiment illustrated in FIG. 4, the beverage dispensing apparatus 34 is adapted for dispensing the finished beverage by gravity forces alone.

In FIG. 4, the mixer 30 is in the form of a beverage homogenizing agitator and is disposed near the bottom of the dispenser 22.

The embodiment illustrated in FIG. 4 can be employed as follows. The flexible bag 12 is filled with a first volume of beverage concentrate at a producing location. Next, the flexible bag 12 is shipped to a dispensing location, typically located many miles apart from the producing location. At the dispensing location, the user lowers the concentrate bag 12 into the dispenser 22 and extends the outlet tube 14 through the pinch valve 38. Next, a second volume of diluent is added to the flexible bag 12 using the diluent filling attachment 36. In embodiments where the total volume of the flexible bag 12 equals the sum of the first volume and the second volume, the exact proportion of diluents can be added by the end user by simply filling the remaining capacity of the bag 12 with diluents through the bag outlet opening 18.

The user then employs the mixer 38 to thoroughly mix the beverage concentrate with the diluent to yield the finished beverage. The finished beverage can now be dispensed via the outlet opening 18 to a dispensing tube (not shown) having a dispensing valve and a dispensing nozzle. After emptying the flexible bag 12, the flexible bag 12 is disposed of.

Figure 5:
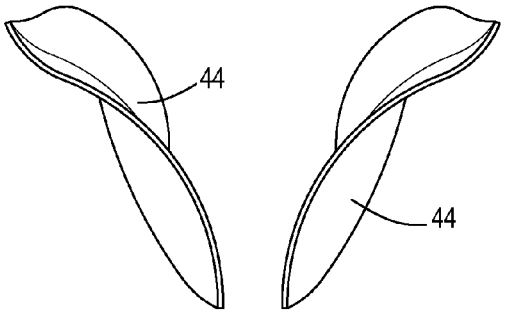
FIG. 5 is a detail perspective diagram of mixing blades useable in the invention.

In the embodiments illustrated in FIGS. 3 and 4, the mixer 30 comprises a pair of mixing blades 44 which slowly oscillate back and forth on the exterior of the flexible bag 12 to "knead" the bag 12, and therefore, mix the contents within the bag 12. FIG. 5 illustrates such pair of mixing blades 44 in detail.

Figure 6:
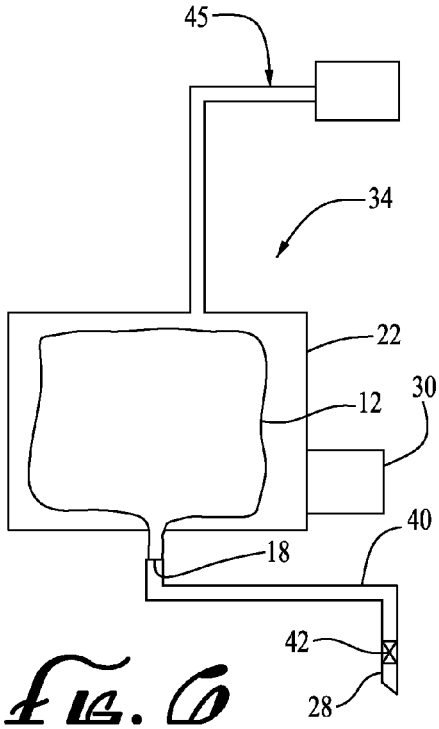
FIG. 6 is a diagrammatic representation in partial cross-section of a third beverage dispensing system having features of the invention.

FIG. 6 illustrates another embodiment of the beverage dispensing apparatus 34. In this embodiment, the disposable, flexible bag 12, partially full of beverage concentrate, is disposed in a dispenser 22. The outlet opening 18 of the flexible bag 12 is attached directly to a disposable dispensing tube 40 having a dispensing valve 42.

The mixer 30 is a vibration mixer adapted to vibrate the dispenser 22. The mixer 30 is typically disposed external of the dispenser 22.

In the embodiment illustrated in FIG. 6, the beverage dispensing apparatus 34 further comprises apparatus 45 for pressurizing the exterior of the flexible bag 12 with a pressurizing gas to facilitate the dispensing of the finished beverage from the bag 12.

Figure 7:
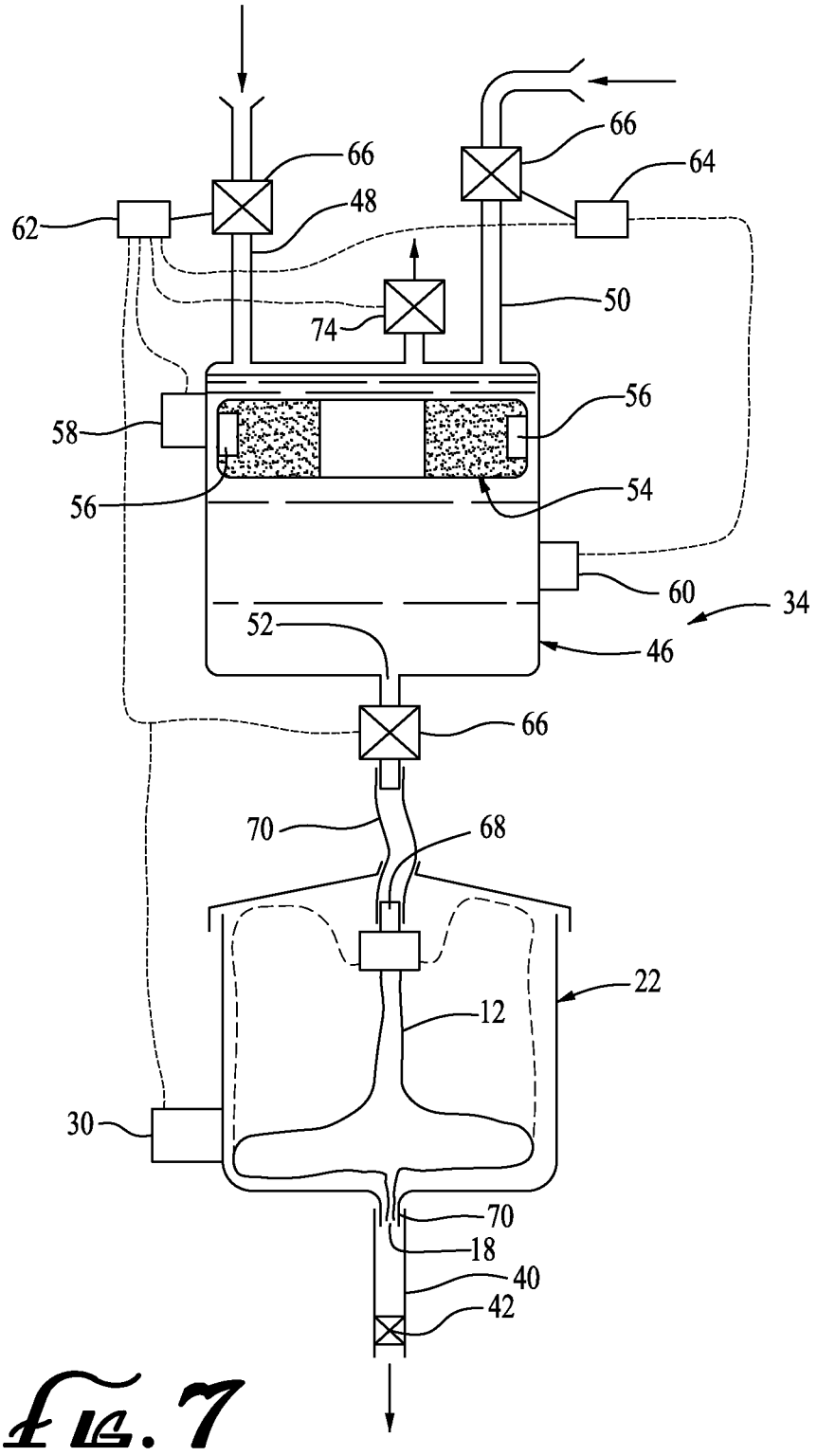
FIG. 7 is a diagrammatic representation in partial cross-section of a fourth beverage dispensing system having features of the invention.

FIG. 7 illustrates yet another embodiment of the beverage distribution apparatus 34 of the invention. This embodiment comprises a dispenser 22 and a diluent reservoir tank 46.

The reservoir tank 46 is adapted to accept diluent (such as tap water) from a source of diluent via a diluent supply line 48. The reservoir tank 46 is adapted to receive pressurized gas (such as a pressurized carbon dioxide/air mixture) from a source of compressed gas through a compressed gas supply line 50. In the embodiment illustrated in FIG. 7, the reservoir tank 46 comprises a reservoir outlet port 52, a float 54 having a pair of opposed magnets 56 and a magnetically activated high-volume sensor 58 and low-volume sensor 60.

In this embodiment of the beverage distribution apparatus 34, a first relay switch 62 and a second relay switch 64 are used to control several solenoid valves 66, which open and close the several fluid carrying lines. The first relay switch 62 also controls an external vibrating mixer 30.

In the embodiment illustrated in FIG. 7, the flexible bag 12 comprises an inlet opening 68, separate from the outlet opening 18. The inlet opening 68 allows access to pressurized gas and diluent from the reservoir tank 46 via a reservoir discharge line 70 which runs between the reservoir outlet port 52 and the dispenser 22.

The embodiment illustrated in FIG. 7 can be operated by a typical user, such as a restaurant operator, as follows. First, the manufacturer of fluid concentrate fills the flexible bag 12 with a first volume of beverage concentrate and ships the bag-and-concentrate combination 10 to the restaurant. The restaurant operator places the flexible bag 12 in the dispenser 22 and connects the inlet opening 68 of the bag 12 to the reservoir discharge line 70. The restaurant operator also passes the flexible bag outlet tube 14 through a dispenser outlet 72 and connects it to a dispensing tube 40 having a closed dispensing valve 42. Preferably, the dispensing tube 40 is disposable.

The operator then activates the first dispenser solenoid relay switch 62 to begin filling the reservoir tank 46 with diluent by (i) closing the water reservoir outlet port 52, (ii) opening a vent valve 74 on the top of the reservoir tank 46, and (c) opening a solenoid valve 66 on the diluent supply line 48.

As the reservoir 46 fills with diluent, the float 54 in the reservoir 46 rises from a low-level position towards a high-level position. The high-level position is located such that, when the float 54 rises to the high-level position, the amount of diluent in the reservoir 46 is a precisely metered second volume which, when mixed with the first volume of concentrate in the concentrate bag 12, will yield a proper finished beverage.

After the water level reaches the high-level position, the high-volume sensor 58 causes the first relay switch 62 to (a) shut off incoming diluent flow, (b) close the vent valve 74 on the reservoir 46, (c) open the reservoir outlet port 52 to begin transferring the second volume of diluent into the flexible bag 12 via the reservoir discharge line 70, (d) cause the second relay switch 64 to open a solenoid valve 66 on the compressed gas supply line 50 to allow compressed gas to pressurize the reservoir 46 to 5-10 psig, and (e) activate the mixer 30 to blend the concentrate and diluent into the finished beverage.

The resulting properly proportioned and fully mixed finished beverage can be dispensed through the dispensing tube 40 by opening the dispensing valve 42. After the flexible bag 12 is empty, the operator disengages and disposes of the bag 12, and replaces it with a new bag-and-concentrate combination 10.

It can be seen that any growth of the bacteria upstream through the dispensing tube 40 is limited to the dispensing tube 40 alone. If the dispensing tube 40 is disposable and frequently replaced, the growth of bacteria is virtually eliminated.

Thus, the invention provides an improved system for preparing and dispensing finished beverages, especially low-acid beverages. The invention provides an improved low-acid beverage dispensing system offering significant reduction in shipping costs while markedly enhancing sanitation, thereby significantly reducing maintenance costs.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A beverage dispensing apparatus for dispensing a finished beverage, the finished beverage comprising a low acid beverage concentrate having a pH greater than 4.6 and a diluent, the beverage dispensing apparatus comprising:

(a) a dispenser compartment;

(b) a beverage concentrate and a flexible concentrate bag situated within the dispenser compartment, the bag having at a lower end region of the bag a first opening through which the beverage concentrate is introduced at a production site and through which the finished beverage is dispensed at a dispensing location and a second opening at the top of the bag, the second opening being used at the dispensing location to introduce the diluent into the bag;

(c) a mixer in the form of a beverage homogenizing agitator situated inside the dispenser compartment and outside the bag proximate the bottom of the bag, the mixer being adapted to minimize sedimentation and to mix the beverage concentrate and the diluent within the bag by agitating at least the bottom of the bag from the outside of the bag and its contents to form the finished beverage; and (d) a dispenser outlet nozzle and a hermetically sealed pinch valve in communication with the first opening of the bag, the nozzle having a sealed end that can be severed, the nozzle extending from a lower end region of the bag for dispensing the finished beverage, the dispenser outlet through which the finished beverage is dispensed at a dispensing location being in fluid tight communication with the bag so that any growth of bacteria is limited;

wherein the second opening for receiving the diluent is disposed upstream from the nozzle, the beverage dispensing apparatus reducing shipping and maintenance costs due to shipping concentrate rather than a finished beverage while enhancing sanitation.

2. A method for dispensing a finished beverage, wherein the finished beverage comprises a mixture of a low acid beverage concentrate and a diluent, the method comprising the steps of:

(a) providing a disposable, flexible sealed concentrate bag with a first opening through which the beverage concentrate is introduced at a production site and through which the finished beverage is dispensed at a dispensing location and a second opening at the top of the bag for introducing the diluent into the bag at the dispensing location;

(b) adding to the bag from step (a) a low acid beverage concentrate with a pH greater than 4.6 at the production site through the first opening of the bag;

(c) shipping the bag and concentrate from step (b) from the production site to a dispensing location separate from the production location;

(d) adding to the bag and concentrate shipped in step (c) a diluent at the dispensing location through the second opening so that a hermetically sealed system is provided that resists bacterial growth;

(e) mixing the beverage concentrate and the diluent within the bag from step (d) using a mixer in the form of a beverage homogenizing agitator that kneads the outside of the bag to produce the finished beverage; and (f) delivering the finished beverage from the first opening of the bag so that the finished beverage flows from the bag under the influence of gravity along an outlet tube through a pinch valve, whereby the bag shrinks by an amount that equals the amount of finished beverage dispensed from the bag without impeding effluent flow so that the bag, the openings, the diluent and the concentrate remain isolated from outside bacteria.

3. A combination of a low acid beverage concentrate, a disposable, flexible hermetically sealed concentrate bag that has a first opening for introducing a concentrate and through which a finished beverage is dispensed and a second opening through which a diluent is introduced and contains the beverage concentrate, a diluent, a diluent supply line for supplying the diluent through the second opening, a dispenser and a mixer supported within the dispenser wherein the beverage concentrate is to be used in a finished beverage including the beverage concentrate and the diluent, the mixer being disposed outside and at the bottom of the bag.

4. A system for dispensing a low acidity beverage, the system comprising:

a flexible hermetically sealed bag containing a beverage concentrate, the flexible sealed bag including a concentrate inlet fitting and an integrally formed bag dispensing tube having a severable outlet end extending from an edge of the bag;

a dispenser compartment sized to receive the flexible sealed bag, the dispenser compartment having a side wall and a funnel-shaped bottom portion including a hole at a lowermost point, the hole being sized to receive the dispensing tube;

a mixer disposed within the dispenser compartment and outside the flexible bag;

a pinch valve that engages the dispensing tube for closing the dispensing tube, the pinch valve being located between the flexible, sealed bag and the severable outlet end of the tube; and a diluent supply connected to a diluent inlet fitting of the flexible, sealed bag.

5. A system for dispensing a low acidity beverage, the system comprising:

a flexible hermetically sealed bag having one opening through which a beverage concentrate is introduced and from which a mixed beverage is dispensed and another opening through which a diluent is introduced, the bag containing the concentrate, the bag including an integrally formed dispensing tube extending from the first opening, the dispensing tube having a severable end;

a dispenser compartment sized to receive the bag therein, the dispenser compartment having a top, a wall, and a bottom portion including a hole at a lowermost point, the hole being sized to receive the dispensing tube;

a mixer disposed within the container and outside the bag;

a diluent fitting hermetically attached to the second opening of the bag; and a pinch valve for closing the dispensing tube, thereby isolating bacteria and controlling effluent flow.

6. A method for shipping a concentrate from a production location and serving a low acid beverage from a dispenser in a commercial or retail environment of use located apart from the beverage concentrate production location, comprising:

providing a concentrate of the beverage in a flexible, disposable, sealed bag with a single purpose diluent inlet fitting and a dual purpose sealingly closable fitting through which the concentrate is introduced at the production location and through which a desired mixed beverage is dispensed after the dual purpose fitting is opened at the commercial or retail environment of use;

shipping the bag and the concentrate to the environment of use;

placing the bag in a dispenser compartment;

diluting the concentrate by adding a diluent to the bag through the single purpose diluent inlet fitting while the bag is in the dispenser compartment to produce a desired beverage;

mixing the concentrate and the diluent to produce the beverage by an agitator; and dispensing the beverage hygienically through a dispensing tube from the bag, so that the beverage does not touch any portion of the dispenser compartment, the dispensing tube having a sealed end that can be cut off to form a bag outlet opening.

* * * * *